US006708364B1

(12) United States Patent
Huber

(10) Patent No.: US 6,708,364 B1
(45) Date of Patent: Mar. 23, 2004

(54) FLEXIBLE BRUSH HEAD FOR A TOOTHBRUSH

(75) Inventor: Beat Huber, Büron (CH)

(73) Assignee: Trisa Holding AG, Triengen (CH)

( * ) Notice: Subject to any disclaimer, the term of this patent is extended or adjusted under 35 U.S.C. 154(b) by 0 days.

(21) Appl. No.: 09/231,293

(22) Filed: Jan. 15, 1999

(30) Foreign Application Priority Data

Jan. 16, 1998 (CH) ..... 0090/98

(51) Int. Cl.[7] ..... A46B 9/04; A46B 9/10
(52) U.S. Cl. ..... 15/167.1; 15/201; 15/176.1
(58) Field of Search ..... 15/167.1, 167.2, 15/176.1, 201

(56) References Cited

U.S. PATENT DOCUMENTS

| | | | | | |
|---|---|---|---|---|---|
| 1,928,328 | A | * | 9/1933 | Carpentier | 15/167.2 |
| 2,443,297 | A | * | 6/1948 | Bressler | 15/201 |
| 2,676,350 | A | | 3/1954 | Bressler | 15/201 |
| 2,888,696 | A | * | 6/1959 | Longert | 15/167.2 |
| 3,065,479 | A | * | 11/1962 | McGee | 15/201 |
| 3,188,672 | A | | 6/1965 | Gary | 15/201 |
| 3,683,442 | A | * | 8/1972 | Holly | 15/201 |
| 4,502,497 | A | * | 3/1985 | Siahou | 15/167.2 |
| 4,683,604 | A | * | 8/1987 | Rueb | 15/176.1 |
| 5,524,319 | A | * | 6/1996 | Avidor | 15/167.1 |
| 5,584,593 | A | * | 12/1996 | Lafortune | 401/184 |
| 5,609,170 | A | * | 3/1997 | Roth | 15/167.1 |
| 5,673,452 | A | * | 10/1997 | Chang et al. | 15/167.1 |
| 5,768,737 | A | * | 6/1998 | Leutwyler et al. | 15/167.1 |
| 5,839,149 | A | * | 11/1998 | Scheier et al. | 15/167.2 |
| 5,946,758 | A | * | 9/1999 | Hohlbein et al. | 15/167.1 |
| 5,946,759 | A | | 9/1999 | Cann | 15/201 |
| 6,006,395 | A | * | 12/1999 | Tiramani et al. | 15/201 |
| 6,514,445 | B1 | | 2/2003 | Cann et al. | 264/243 |

FOREIGN PATENT DOCUMENTS

| | | |
|---|---|---|
| DE | 1657299 | 2/1971 |
| WO | WO 9119438 | 12/1991 |
| WO | WO 9217093 | 10/1992 |
| WO | WO 96/02165 | 2/1996 |
| WO | WO 97/25899 | 7/1997 |

* cited by examiner

*Primary Examiner*—Theresa T. Snider
(74) *Attorney, Agent, or Firm*—Oliff & Berridge, PLC

(57) ABSTRACT

Flexible brush head (14) for a toothbrush (10), having a bristle carrier (16) which consists of a first, hard, elastic plastic and is subdivided by segments (17), which are arranged one behind the other in the longitudinal direction of the brush head (14), by tunnels (20) running transversely with respect to the longitudinal axis of the brush head (14). The segments (17) of the bristle carrier (16) and the tunnels (20) extend preferably over the entire width of the brush head (14). The tunnels (20) are filled with a second, soft, elastic plastic and connected to one another via a groove (30) provided laterally on the bristle carrier (16). The regions (22, 22') of the bristle carrier (16), which bound the tunnels (20) on the bristle-carrying side of the brush head (14) and on the side located opposite the bristle-carrying side, are elastically deformable and, in the event of the bristle-carrier segments (17) being deflected during use, act as a bending-limiting structure.

15 Claims, 6 Drawing Sheets

FLEXIBLE BRUSH HEAD FOR A TOOTHBRUSH

BACKGROUND OF THE INVENTION

The invention relates to a flexible brush head for a toothbrush.

The object of the present invention is to provide a flexible, adaptable brush head which allows better cleaning of the teeth as a whole.

BRIEF SUMMARY OF THE INVENTION

The design of the brush head according to the invention makes it very flexible. It has a bristle carrier which is made of a first, hard but elastic plastic and is divided up into at least two segments, which are located one behind the other along the longitudinal axis of the brush head, by at least one recess, which passes through the bristle carrier, in the form of a tunnel, transversely with respect to the longitudinal axis of the brush head.

The segments of the bristle carrier, and preferably also the tunnel, extend over the entire width of the brush head, the tunnel preferably being filled with a second, rubber-elastic plastic, which is much softer than the first plastic of the bristle carrier, with the result that there is no risk of the tunnel being contaminated. The design described allows the individual segments of the bristle carrier to be deflected with respect to one another, which results in the brush head being flexible. Since the brush head can bend about an axis running transversely with respect to the longitudinal axis of the brush head, adaptation both to the outsides and the insides of the teeth is possible, this allowing more careful cleaning of the teeth, of the spaces between the teeth and of the gum line. Slight turning of the individual segments of the bristle carrier with respect to one another, that is to say slight torsion of the brush head, is also possible, this further improving adaptation of the brushing surface, which is produced by the bristles or bristle clusters, to the shapes of the individual teeth and of the teeth as a whole, and thus further improving the cleaning operation. If the brush head is subjected to pronounced or excessive pressure, it bends to a correspondingly more pronounced extent and thus compensates for some of the pressure. This means that gentler and more careful cleaning is possible.

If the brush head has more than just two segments and, accordingly, more than one tunnel, then the flexibility of the brush head increases and the effects outlined are enhanced.

The flexibility of the brush head can be increased further if the regions of the bristle carrier which bound the tunnels on the bristle-carrying side of the bristle carrier and on the side which is located opposite the bristle-carrying side of the bristle carrier are configured such that they can be expanded and/or compressed in the longitudinal direction of the brush head. In order to achieve greater stability of the brush head, it is expedient for these regions to be configured in the expansible form described just on one side in each case, and advantageously on the bristle-carrying side. A configuration in the form of a web which is folded in the manner of an accordion is particularly suitable. A bristle-carrier region which is configured in expansible form with or without folding and bounds the tunnel of said sides yields elastically to its limit of expansion and thus acts as a bending-limiting means. When the limit of expansion is reached, further deflection or turning of the segments with respect to one another is only possible by force being applied. Automatic return of the segments into their original position is effected predominantly by the elastic restoring action of said bristle-carrier regions which bound the tunnels, and also by the second, soft, elastic plastic, with which the tunnel is filled and which is joined firmly to the first, hard, elastic plastic of the bristle carrier.

For producing a brush head of the type described, it is advantageous if, for the case where more than one tunnel is provided in the brush head, the tunnels are connected to one another, since it is easier in this way for them to be filled with the second, soft, rubber-elastic plastic. If the intention is to produce entire toothbrushes, then it is advantageous to form the brush head integrally on a brush handle or a plug-on part and to produce said handle or plug-on part likewise from the first, hard but elastic plastic.

Further advantageous embodiments of the brush head and toothbrushes with brush heads according to the invention are seen in the several drawing figures and are described herein.

BRIEF DESCRIPTION OF THE DRAWINGS

Exemplary embodiments of the brush head according to the invention are explained hereinbelow with reference to the drawings.

The various figures, numbered 1 to 5, each show, purely schematically, a toothbrush, consisting of two different plastic materials, with part of a brush handle and with in each case a different embodiment of the brush head according to the invention, the illustrations of the individual figures being as follows.

DETAILED DESCRIPTION OF THE PREFERRED EMBODIMENT

Figures 1A, 1B, 1C, 1D, 1E, 1F, 1G:
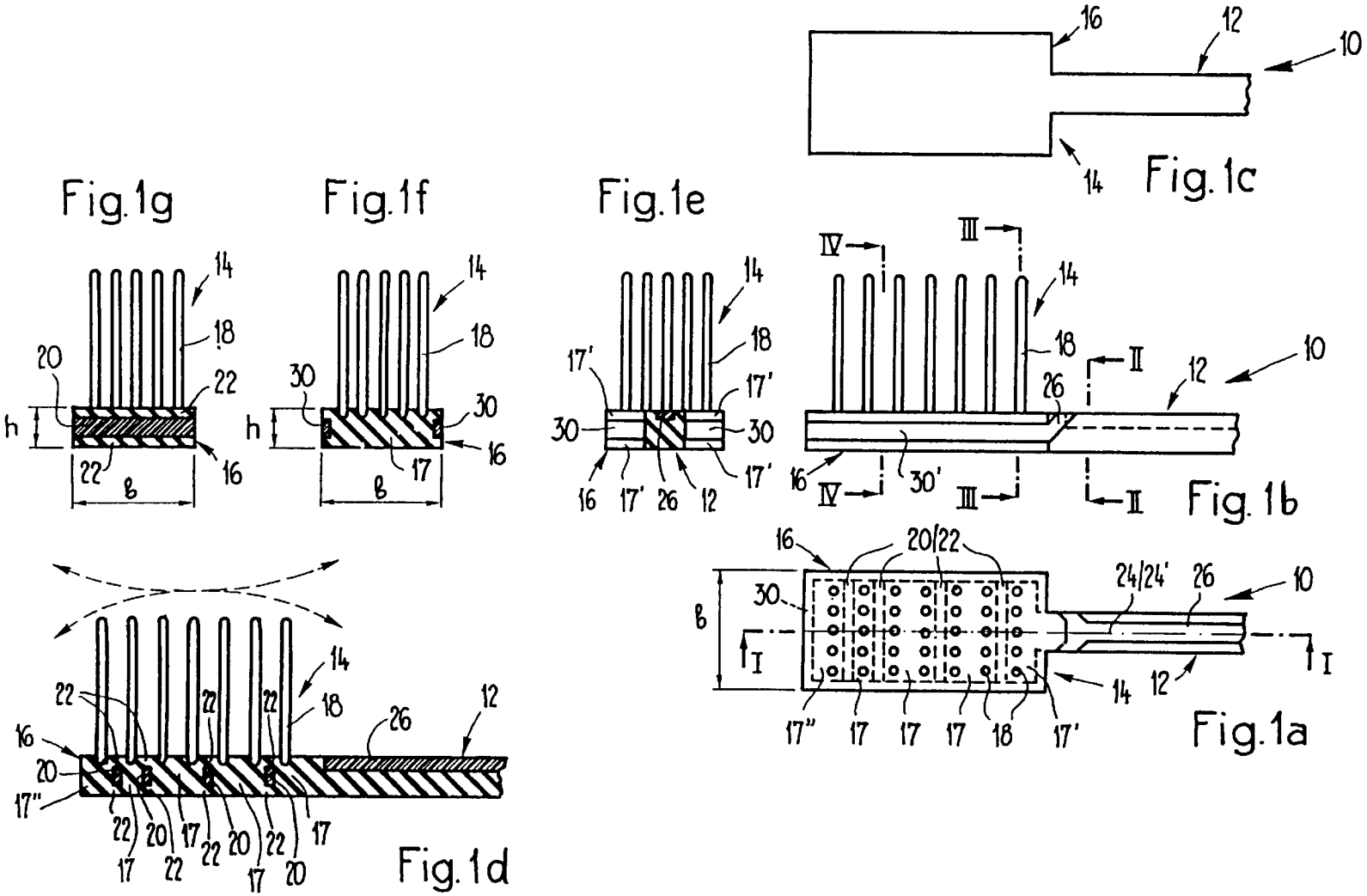
FIG. 1*a* shows a plan view of the bristle-carrying side of such a toothbrush.
FIG. 1*b* shows a side view of the toothbrush illustrated in FIG. 1*a;*
FIG. 1*c* shows a view of the rear side, which is located opposite the bristle-carrying side, of the toothbrush illustrated in FIGS. 1*a* and 1*b;*
FIG. 1*d* shows a longitudinal section along the line I—I in FIG. 1*a;*
FIG. 1*e* shows a section through the brush handle along the line II—II in FIG. 1*b;*
FIG. 1*f* shows a section through the brush head along the line III—III in FIG. 1*b;*
FIG. 1*g* shows a section through the brush head along the line IV—IV in FIG. 1*b;*

FIGS. 1*a–g* show a toothbrush 10 with part of a brush handle 12 and a brush head 14 with a bristle carrier 16. The bristle carrier 16, which consists of a first, hard but elastic plastic, is subdivided into five segments 17 (FIGS. 1*a*, 1*d*) by tunnels 20, which pass through the bristle carrier 16 over its entire width, different numbers of rows of bristles combined to form bristle clusters 18 being anchored in said five segments. The segments 17 of the bristle carrier 16 extend, as do the tunnels 20, over the entire width b of the brush head 14 in each case (FIGS. 1*f*, 1*g*). The tunnels 20 between the segments 17 of the bristle carrier 16 (FIGS. 1*d*, 1*g*) are filled with a second, soft, rubber-elastic plastic, which is joined firmly to the first, hard, elastic plastic of the bristle carrier 16. The tunnels 20 are thus entirely surrounded by the hard, elastic plastic of the bristle carrier 16. On the bristle-carrying side of the brush head 14 and on that side of the brush head 14 which is located opposite the bristle-carrying side, the tunnels are bounded by regions 22 of the bristle carrier 16, said regions being web-like and of thin design and thus being very flexible.

In the center of its sides forming the lateral border of the brush head 14, the bristle carrier 16 has a lateral groove 30 which is the same height as the tunnels 20 (FIGS. 1*b*, 1*e*, 1*f*). The tunnels 20 are connected to one another via the lateral groove 30, which runs more or less around the entire brush head 14 and is likewise filled with the second, soft, rubber-elastic plastic.

The brush head 14 and brush handle 12 are connected integrally to one another via the segment 17' of the bristle carrier 16, said segment 17' being adjacent to the brush handle 12, it being the case that the brush handle 12 likewise consists of the hard but elastic plastic of the bristle carrier 16 (FIGS. 1*a* to 1*d*). The brush handle 12 has a handle groove 26 which extends, on the bristle-carrying side of the toothbrush 10, along the longitudinal axis 24 of the toothbrush 10 (FIG. 1*a*). Just in front of the brush head 14, this handle groove 26 divides (FIG. 1*a*) and runs obliquely toward the brush head 14 along the lateral sides of the brush handle 12 and merges into the lateral groove 30 (FIG. 1*b*). In the same way as the lateral groove 30, the handle groove 26 is filled with the second, soft, rubber-elastic plastic.

As a result of the large number of segments 17, into which the bristle carrier 16 is subdivided by the tunnels 20, and on account of the relatively thin and thus very flexible regions 22 of the bristle carrier 16, the brush head 14 as a whole is very flexible and can easily be bent and turned with torsional movement along the center longitudinal axis 24' of the brush head 14. This achieves better adaptation of the brushing surface to the curves of the teeth and the spaces between the teeth as well as better cleaning. The tunnels 20 thus increase the flexibility of the brush head 14. However, at the same time, the regions 22 of the bristle carrier 16, which bound the tunnels 20 on the bristle-carrying side of the brush head 14 and on that side of the brush head 14 which is located opposite the bristle-carrying side, reduce the risk of part of the brush head 14 being bitten off during use.

The integral connection between the brush handle 12 and brush head 14 and the connection of the tunnels 20 to one another via the lateral groove 30 of the bristle carrier 16 permit, together with the connection of the lateral groove 30 and handle groove 26, very straightforward production of the entire toothbrush with the brush head 14 according to the invention by two-component injection molding.

An embodiment which is modified slightly with respect to the embodiment outlined in FIGS. 1*a* to 1*g* is illustrated in FIGS. 2*a* to 2*e*.

Figure 2A:
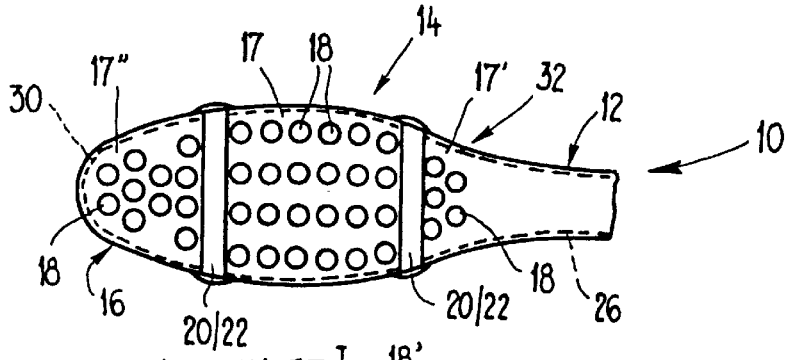
FIG. 2*a* shows a toothbrush with a further embodiment of the brush head according to the invention and with the transition to a brush handle in the plan view of the bristle-carrying side.

The embodiment illustrated in FIGS. 2*a* to 2*e* shows a toothbrush 10 with a further embodiment of the brush head 14 and with a short section of a brush handle 12. The brush head 14, which has a bristle carrier 16 subdivided into three segments 17 by tunnels 20, is formed integrally on the brush handle 12 (FIG. 2*a*). The first segment 17' of the bristle carrier 16, the segment 17' being adjacent to the brush handle 12 and also having a number of bristle clusters 18 anchored in it, forms a transition region 32 to the brush handle 12.

As in the embodiment illustrated in FIGS. 1*a* to 1*g*, it is also the case here that tunnels 20 are located between the segments 17 of the bristle carrier 16, which extend over the entire width of the brush head 14, said tunnels 20 likewise extending over the entire width of the brush head 14 (FIGS. 2*a*, 2*b*, 2*d*, 2*e*) and being filled with the second, soft, rubber-elastic plastic.

As in the embodiment shown in FIGS. 1*a* to 1*g*, it is also the case here that a lateral groove 30, which is made in the side of the bristle carrier 16 and is filled with the soft, elastic plastic, connects the tunnels 20 to one another. For the purpose of straightforward production, the integrally formed brush handle 12 also has a groove 26 on the two lateral surfaces, the groove merging into the groove 30 of the bristle carrier 16 in the transition region 32 (FIGS. 2*b*, 2*d* and 2*e*) and being filled with the second, soft, rubber-elastic plastic.

Figure 2B:
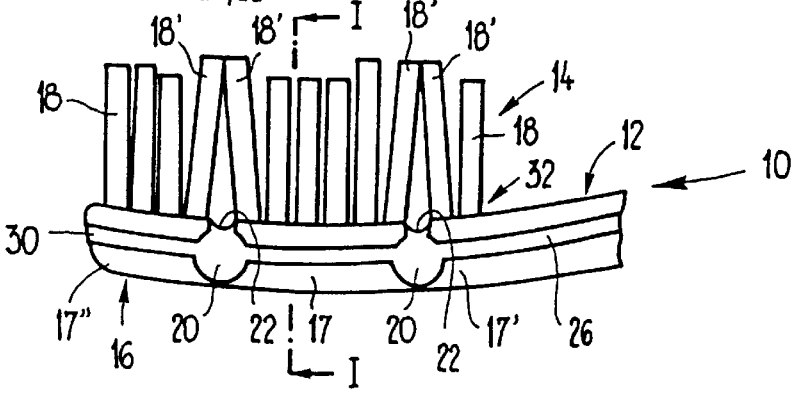
FIG. 2*b* shows a side view of the toothbrush illustrated in FIG. 2*a;*
Figure 2C:
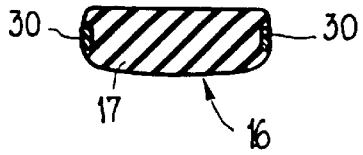
FIG. 2*c* shows a section through the brush head along the line I—I in FIG. 2*b*, the bristle clusters not being illustrated.
Figure 2D:
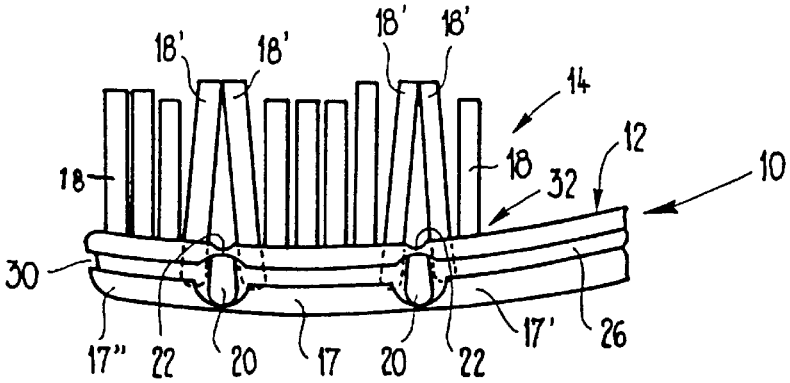
FIG. 2*d* shows a side view of the core of the toothbrush illustrated in FIGS. 2*a* and 2*b*, said core consisting of the first, hard but elastic plastic.
Figure 2E:
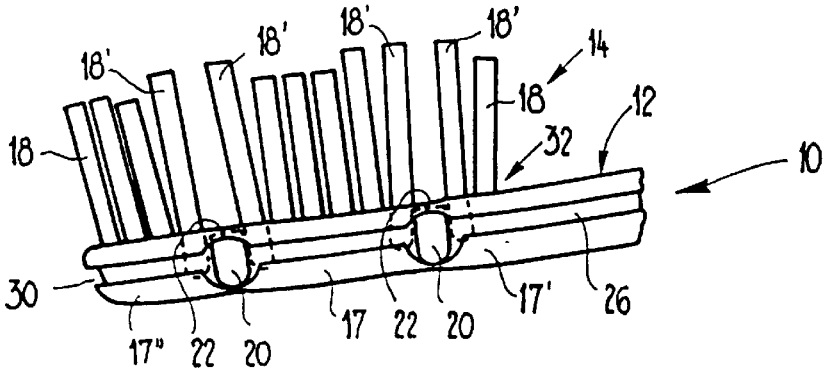
FIG. 2*e* shows an illustration, analogous to FIG. 2*d*, where the toothbrush shown in FIGS. 2*a* and 2*b* is subjected to bending stress.

FIGS. 2*d* and 2*e* show just the core, which consists of the first, hard but elastic plastic, i.e. the filling of the tunnels 20 and of the grooves 26 and 30 made of the second, rubber-elastic plastic is not illustrated.

The tunnels 20 are entirely surrounded by the first, hard, elastic plastic of the bristle carrier 16. The regions 22 of the bristle carrier 16, which bound the tunnels 20 on the bristle-carrying side of the toothbrush 10 (FIGS. 2*b*, 2*d*, 2*e*), are very thin and of slightly curved design (FIGS. 2*b*, 2*c*), with the result that they appear on the bristle-carrying side of the brush head 14 as hollowed channels (FIG. 2*a*). Under use-induced loading, these slightly curved regions 22 of the bristle carrier 16 extend (FIG. 2*d*) and, in the fully stressed state, resist any further bending of the bristle carrier 16 (FIG. 2*e*). The regions 22 of the bristle carrier 16 which are formed in this way thus, on the one hand, increase flexibility and, on the other hand, act as a bending-limiting means, which prevents excessive bending of the brush head.

The regions 22' of the bristle carrier 16, which bound the tunnels 20 on the side which is located opposite the bristle-carrying side, are likewise thin and elastic, with the result that they are compressed elastically when the bristle carrier 16 is bent during use of the toothbrush, as is illustrated in FIG. 2*e*.

The bristle clusters which are designated by 18' in FIGS. 2*b*, 2*d* and 2*e* and belong to the rows adjacent to the tunnels 20 are positioned obliquely. As FIGS. 2*b*, 2*d* and 2*e* show, the oblique positioning is such that the bristle clusters 18', which are each arranged on both sides of a tunnel 20, are inclined toward one another, thus covering over the tunnel region located therebetween (FIGS. 2*b* and 2*d*). Those receiving holes which are formed in the segments 17 of the bristle carrier 16 and are intended for the bristle clusters 18' are correspondingly positioned obliquely.

Figures 3A, 3B, 3C, 3D, 3E, 3F, 3G:
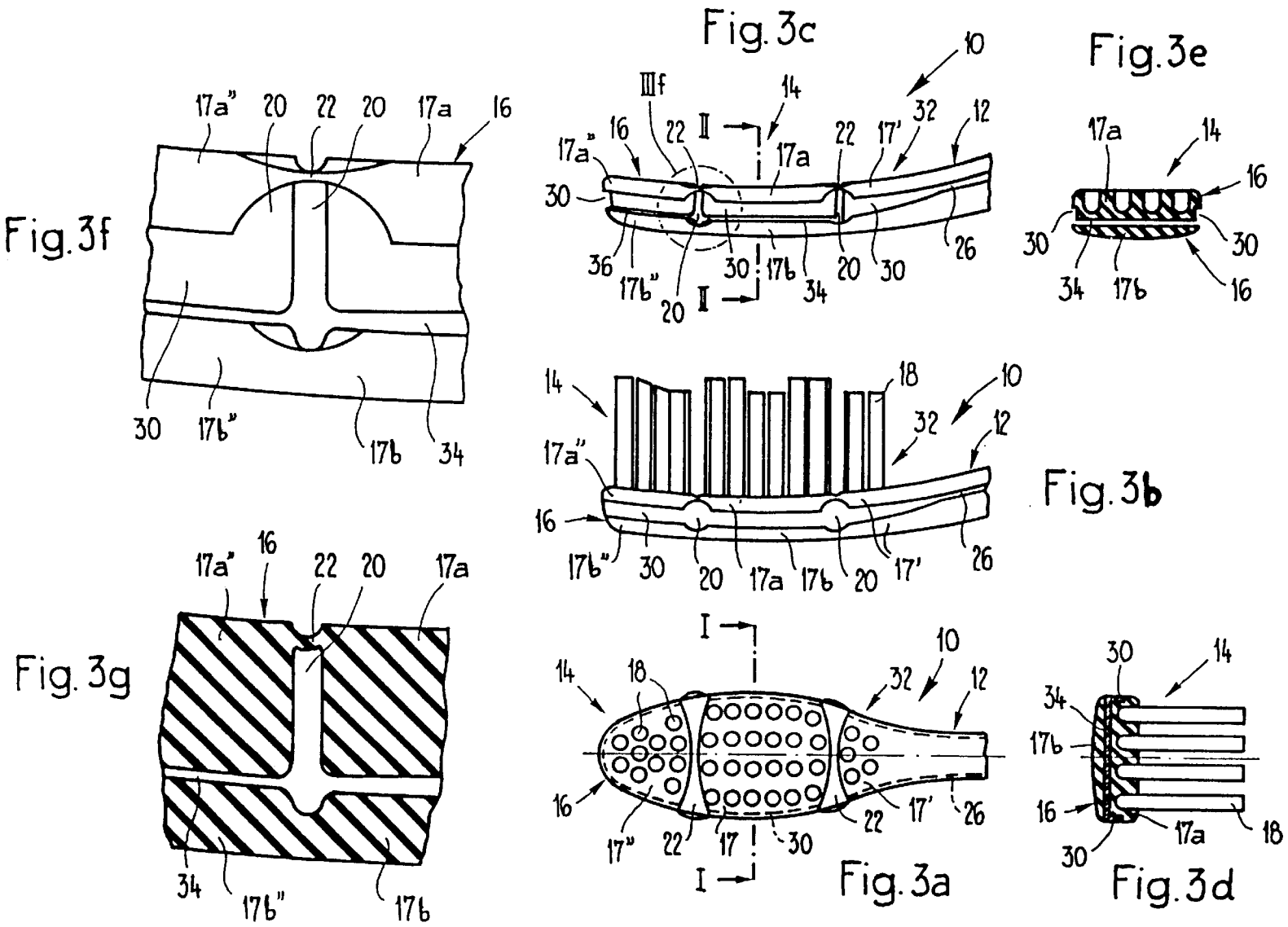
FIG. 3*a* shows a toothbrush with a further embodiment of the brush head according to the invention and with the transition to a brush handle in the plan view of the bristle-carrying side.
FIG. 3*b* shows a side view of the toothbrush illustrated in FIG. 3*a;*
FIG. 3*c* shows a side view of the core of the toothbrush illustrated in FIGS. 3*a* and 3*b*, said core consisting of the first, hard but elastic plastic.
FIG. 3*d* shows a section along the line I—I in FIG. 3*a;*
FIG. 3*e* shows a section along the line II—II in FIG. 3*c;*
FIG. 3*f* shows an enlarged illustration of a tunnel, and of the bristle-carrier regions bounding it, according to FIG. 3*c;*
FIG. 3*g* shows the enlarged region of FIG. 3*f* in a section along the center longitudinal axis of the brush head.

The embodiment illustrated in FIGS. 3*a* to 3*g* is of the same basic design as the brush head 14 shown in FIGS. 2*a*–2*e*. However, the tunnels 20 widen in a trumpet-like manner toward the border of the brush head 14 (FIG. 3*a*). The regions 22 of the bristle carrier 16, which bound the tunnels 20 on the bristle-carrying side of the toothbrush 10 (FIGS. 3*c*, 3*f*, 3*g*), are likewise thin and of slightly curved design, with the result that toward the bristle-carrying side, together with the borders of the segments 17 of the bristle carrier 16, they too form hollowed channels running transversely over the brush head 14 (FIG. 3*a*). Since the tunnels 20 widen in a trumpet-like manner toward the border of the brush head 14, the channels on the bristle-carrying side of the brush head 14, which are formed by the regions 22, also appear in plan view in a form in which they widen in a trumpet-like manner toward the border of the brush head 14 (FIG. 3*a*). Just like the regions 22 of the bristle carrier 16 in the embodiment described in FIGS. 2*a* to 2*e*, it is also the case here that the regions 22 of the bristle carrier 16 increase flexibility and act as a bending-limiting means.

The central segment 17 and the segment 17" of the bristle carrier 16, the segment 17" being located opposite the brush handle 12, are subdivided in this embodiment into two parts 17*a*, 17*b* by an interspace 34 which extends over the entire width of the brush head 14 (FIGS. 3*c*, 3*e*). This interspace 34 connects the tunnels 20 to one another and is likewise filled with the second, soft, elastic plastic (FIG. 3*d*). The interspace 34 with its soft, rubber-elastic filling makes it possible for the segments 17 of the bristle carrier 16 to be tilted along, and transversely with respect to, the longitudinal axis 24 of the brush head 14.

A small web 36 at that end of the brush head 14 which is located opposite the brush handle 12, said web connecting the bristle-carrying part 17"*a* to the part 17"*b* of the segment 17", said part 17"*b* being located opposite the bristle-carrying part, prevents the two parts 17"*a* and 17"*b* of the segment 17" from spreading apart during use and prevents the join between these parts 17"*a*, 17"*b* and the soft, elastic plastic in the interspace 34 from being released (FIG. 3*c*). The segment 17' of the bristle carrier 16, being located at the other end of the brush head 14 and being adjacent to the brush handle 12, is not separated by the interspace 34. Said segment merges into the brush handle 12 (FIG. 3*c*), which is produced from the same hard, elastic plastic as the bristle carrier 16.

The basic design of the brush head 14 shown in FIGS. 4*a* to 4*g* is the same as that of the brush head 14 illustrated in FIGS. 1*a* to 1*g*. The two have a bristle carrier 16 which is subdivided into five segments 17 by tunnels 20 and is made of hard, elastic plastic.

Figures 4A, 4B, 4C, 4D, 4E, 4F, 4G:
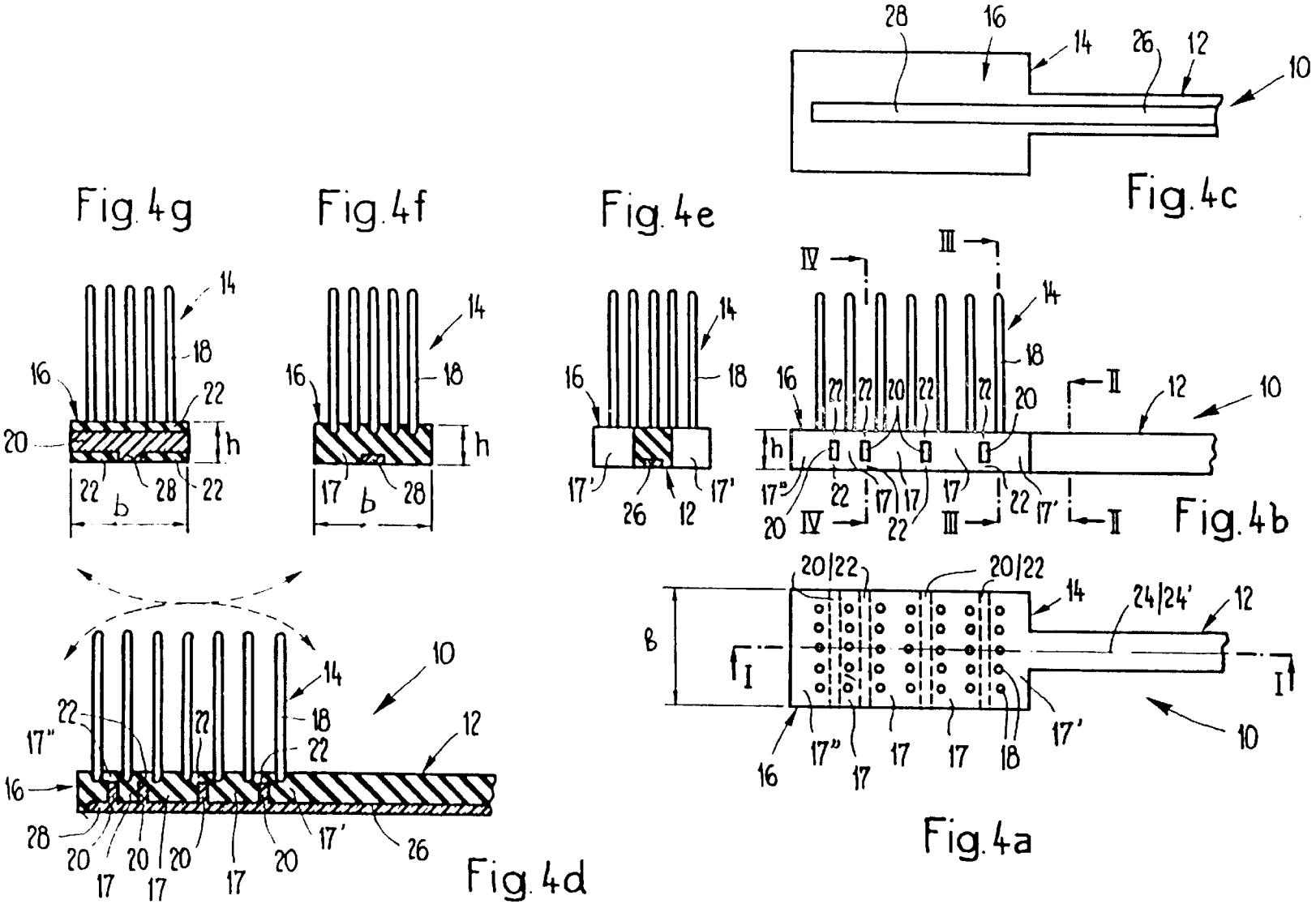
FIG. 4*a* shows a toothbrush with a further embodiment of the brush head according to the invention and with the transition to a brush handle in the plan view of the bristle-carrying side.
FIG. 4*b* shows a side view of the toothbrush illustrated in FIG. 4*a;*
FIG. 4*c* shows a view of the rear side, which is located opposite the bristle-carrying side, of the toothbrush illustrated in FIGS. 4*a* and 4*b;*
FIG. 4*d* shows a longitudinal section along the line I—I in FIG. 4*a;*
FIG. 4*e* shows a section through the brush handle along the line II—II in FIG. 4*b;*
FIG. 4*f* shows a section through the brush head along the line III—III in FIG. 4*b;*
FIG. 4*g* shows a section through the brush head along the line IV—IV in FIG. 4*b;*

The difference between the embodiment shown in FIGS. 1*a* to 1*g* and the embodiment shown in FIGS. 4*a* to 4*g* is that in that embodiment of the brush head 14 which is outlined in FIGS. 4*a* to 4*g* the bristle carrier 16 has a groove 28 instead of a lateral groove 30, this groove 28 extending, along the center longitudinal axis 24', on the rear side, which is located opposite the bristle-carrying side, of the brush head 14 (FIG. 4*c*). The groove 28, which is filled with the second, soft, rubber-elastic plastic, passes through the bristle carrier 16 such that the tunnels 20 are connected to one another via the groove 28 (FIGS. 4*c*, 4*d*, 4*f*, 4*g*).

For cost-effective production by two-component injection molding, the brush handle 12 has on the rear side, which is located opposite the bristle-carrying side, of the toothbrush 10 a handle groove 26 which, in the region of the brush head 14, merges into the groove 28 along the center longitudinal axis 24' of the brush head 14. Both grooves 26 and 28 are filled with the soft, rubber-elastic plastic (FIGS. 4*c*, 4*d*, 4*e*).

The possible variations of the brush head 14 according to the invention are by no means covered in full by the embodiments described and illustrated in the figures. As is also made clear, in particular, by the exemplary embodiments shown in FIGS. 2*a* to 2*e* and 3*a* to 3*g*, the geometrical configuration of the bristle carrier 16, as seen in plan view, may be virtually of any desired shape. It is thus not necessary for the bristle carriers 16 and their segments 17 to be of rectangular design, as is illustrated in the examples of FIGS. 1*a* to 1*g* and 4*a* to 4*g*. The same also applies for the tunnels 20 between the segments 17 of the bristle carriers 16, as is illustrated in FIGS. 3*a*, 3*c*, 3*f*. Variations in the outwardly visible distribution between parts made of the first, hard, elastic plastic and the second, soft, rubber-elastic plastic for design reasons are, of course, likewise conceivable.

In all the exemplary embodiments shown, the tunnels 20 extend over the entire width of the bristle carrier 16 and run continuously from side border to side border. It is, then, also conceivable for the tunnels 20 to be of non-continuous configuration, i.e. for the tunnels 20 to be interrupted by an intermediate element.

It is also possible to dispense with the tunnels 20 being filled with the second, soft, elastic plastic. In such an embodiment, the lateral groove 30 and/or the groove 28 and the handle groove 26 can be omitted. As a result, the brush handle 12 and the bristle carrier 16, subdivided into segments 17 by the tunnels 20, of such an embodiment consist just of a single material, that is to say the first, hard, elastic plastic.

It is possible for the brush head 14 designed according to the invention to be used not just for a manual toothbrush, as shown, but also for plug-on toothbrushes, as are used for electric toothbrushes. In the case of such a plug-on toothbrush, the brush head 14 according to the invention is connected to a plug-on part.

Instead of the brush head 14 being designed integrally with the brush handle 12 or the plug-on part, it is also possible for the brush head 14 to be connected to the brush handle 12 or the plug-on part in an exchangeable manner.

The configuration of the bristles or bristle clusters 18 may likewise be varied, as has already been indicated in FIG. 3*b* by the different lengths of the bristle clusters 18 and the brushing surfaces, some of which are cut obliquely. As has been mentioned, it is also possible for crosswise bristles or bristle clusters 18 which are positioned obliquely with respect to one another, as is illustrated in FIGS. 2*b* and 2*d*, to be expedient and additionally to aid better cleaning of the teeth as a whole.

Figure 6:
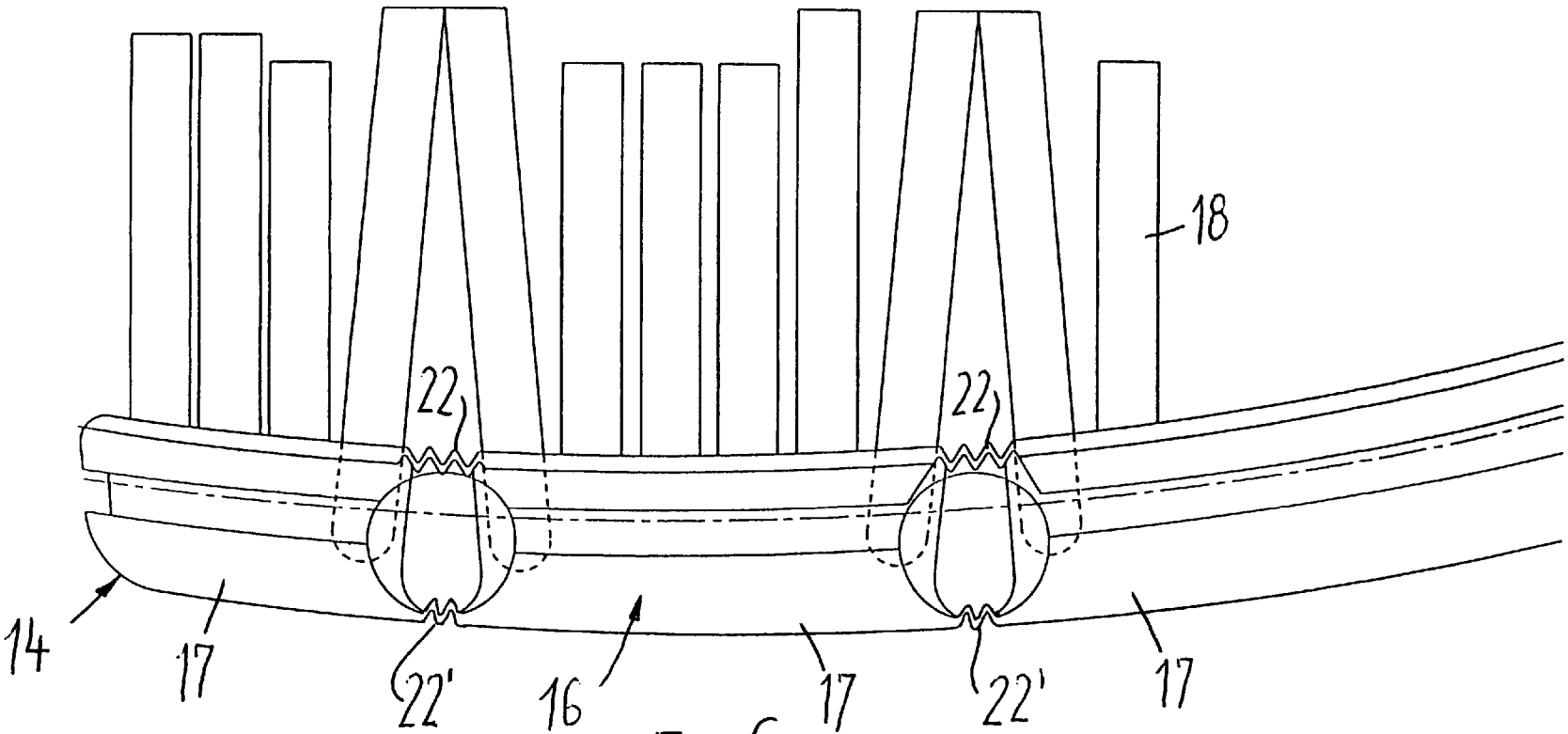
FIG. 6 is an enlarged side elevation of a further modified form of the invention wherein the side-to-side tunnels through the brush head are bounded at the top and bottom by flexible accordion-like pleats.

It is also possible for those regions 22 of the bristle carriers 16 which bound the tunnels 20 to be of different configurations. As described for the embodiments shown in FIGS. 2*a*–2*e* and 3*a*–3*g*, the flexibility of the brush head 14 can be increased if the regions 22 of the bristle carriers 16 are thin and of slightly curved configuration. However, the capacity for expansion of these regions 22 in the longitudinal direction of the brush head 14 may also be improved, for example, by the regions 22 being thinned out toward their center. A very expansible, and thus very advantageous, form of these regions 22 is achieved by a thin configuration which is folded in the manner of an accordion in the longitudinal direction of the brush head 14. This accordion-like construction is seen in FIG. 6 wherein the brush head has two side-to-side transverse tunnels similar to those in FIGS. 2*d* or 2*e*, but wherein the thin connecting webs at the top and bottom of the tunnels at 22 and 22' are formed as longitudinally extending zigzag pleats to facilitate brush head flexibility. This also applies correspondingly for the regions 22' on the rear side, which is located opposite the bristle-carrying side, of the bristle carrier 16, said regions 22' being compressed elastically when the bristle-carrier segments 17 are deflected by force being applied to the bristle clusters 18.

Figure 5A:
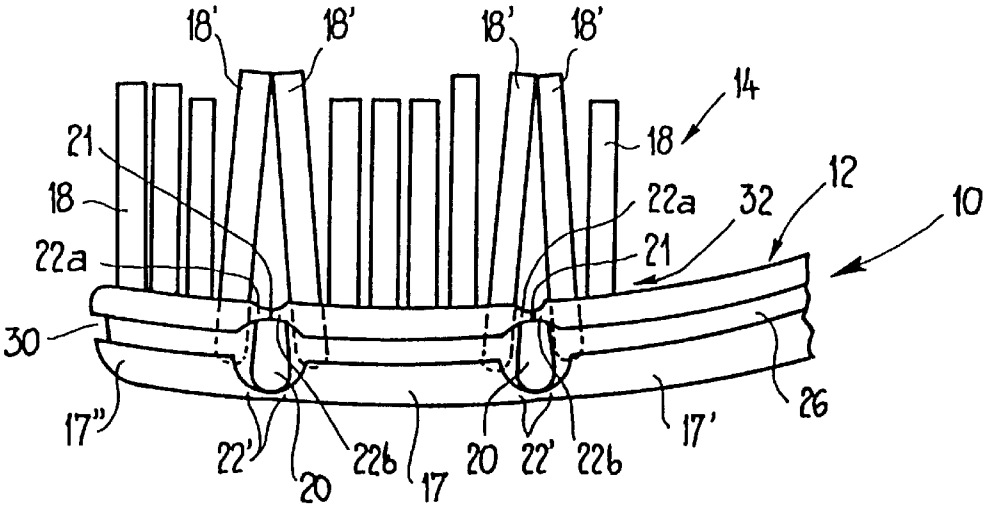
FIG. 5*a* shows a toothbrush with a further embodiment of the brush head according to the invention, said embodiment being analogous to the brush head shown in FIGS. 2*a* to 2*e*, in an illustration corresponding to that in FIG. 2*d;*
Figure 5B:
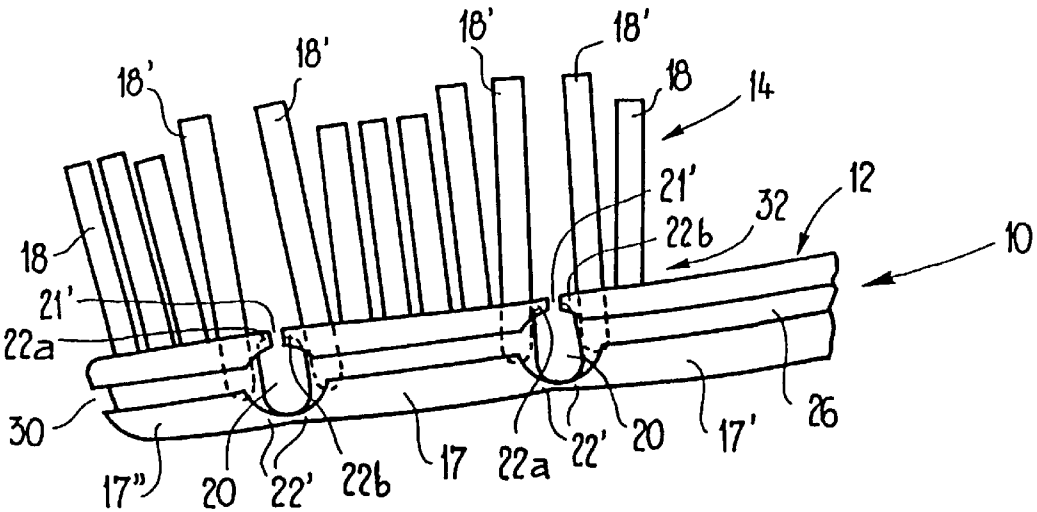
FIG. 5*b* shows an illustration where the toothbrush illustrated in FIG. 5*a* is subjected to bending stress.

A configuration of these regions 22 of the bristle carrier 16 such as that illustrated in FIGS. 5*a* and 5*b* also results in very high flexibility of the brush head. FIGS. 5*a* and 5*b* show a toothbrush 10 which has a brush head 14 and is constructed analogously to the embodiment shown in FIGS. 2*a* to 2*e*. However, of the thin regions 22 and 22', which cover over the tunnels 20, in the embodiment shown here the regions 22 on the bristle-carrying side of the brush head 14 are subdivided into two sections 22*a* and 22*b* by a parting plane 21 extending over the entire width of the brush head 14, said two sections being in closing contact in the normal state, as shown in FIG. 5*a*. Under bending stress, the parting plane 21 widens to form a gap 21', as is illustrated in FIG. 5*b*, which permits a large degree of bending. The restoring force of the soft, elastic plastic material in the tunnels 20 ensures that, as the bending stress decreases, the gap 21' closes again to the full extent and the sections 22*a* and 22*b* of the regions 22 butt against one another again with closing contact. It is also the case in terms of torsional stress along the longitudinal axis 24' of the bristle carrier 16 that the parting plane 21 in the regions 22 increases the flexibility of the brush head 14.

What is claimed is:

1. A flexible brush head for toothbrushes comprising:

a bristle carrier which consists of a hard yet elastic plastic, in which are anchored projecting bristles on an upper side thereof, which are combined to form bristle clusters, which bristle carrier is subdivided into at least two bristle-carrying segments arranged one behind the other along the longitudinal axis of the bristle carrier, at least one tunnel within the bristle carrier bound on the upper side as well as on a bottom side, opposite the upper side, by a region of the bristle carrier and extending transversely with respect to the longitudinal axis of the bristle carrier from one lateral side thereof to the other and disposed longitudinally of the bristle carrier between each two bristle carrying segments.

2. The brush head as claimed in claim 1, wherein the region of the bristle carrier which bounds each said tunnel on the upper side is of substantially reduced thickness compared to the segments on either side thereof, and wherein the region can be expanded in the direction of the longitudinal axis of the bristle carrier.

3. The brush head as claimed in claim 2, wherein the region of the bristle carrier, which bounds each said tunnel on the upper side, is folded in the manner of an accordion in the longitudinal direction of the bristle carrier.

4. The brush head as claimed in claim 2, wherein the region of the bristle carrier, which bounds each said tunnel on the upper side, is subdivided into two abutting sections by a parting plane extending over the entire width of the bristle carrier.

5. The brush head as claimed in claim 1 wherein the region of the bristle carrier which bounds each said tunnel on the bottom side is of substantially reduced thickness compared to the segments on either side thereof, and wherein the region can be compressed elastically in the direction of the longitudinal axis of the bristle carrier.

6. The brush head as claimed in claim 5, wherein the region of the bristle carrier, which bounds each said tunnel on the bottom side is folded in the manner of an accordion in the longitudinal direction of the bristle carrier.

7. The brush head as claimed in claim 1, wherein said at least one tunnel includes at least two tunnels and the bristle carrier is divided up into at least three segments by said at least two tunnels, said at least two tunnels being connected to one another.

8. The brush head as claimed in claim 7, wherein, laterally, the bristle carrier has a lateral groove via which the tunnels are connected to one another and which is filled with a pliable elastic plastic.

9. The brush head as claimed in claim 7, which comprises a groove which extends along the center longitudinal axis of the bristle carrier, which is arranged on the bottom side, passes through the bristle carrier, connecting the tunnels to one another, and is filled with a pliable, elastic plastic.

10. The brush head as claimed in claim 7, which comprises an interspace which extends over the entire width of the bristle carrier, separates at least some of the segments of the bristle carrier approximately halfway up the height (h) of the bristle carrier into upper and lower portions, connects at least some of the tunnels in the upper portion to tunnels in the lower portion, and is filled with a pliable, elastic plastic.

11. The brush head as claim in claim 10, wherein the interspace extends into the segment, which is located opposite a brush handle, said segment having a bristle-carrying part and a part located opposite the bristle-carrying part, with the parts connected to one another at least at one location.

12. The brush head as claimed in claim 1, wherein said at least one tunnel is filled with a pliable, elastic plastic.

13. A toothbrush having a brush head and a brush handle, wherein the brush head is configured according to claim 1.

14. The toothbrush as claimed in claim 13, wherein the brush head is formed integrally on the brush handle.

15. The toothbrush as claimed in claim 13, wherein the brush head is fastened on the brush handle in a removable manner.

* * * * *